US005993094A

United States Patent [19]

Lee

[11] Patent Number: 5,993,094

[45] Date of Patent: Nov. 30, 1999

[54] PAPER EJECT APPARATUS AND METHOD OF AN INK-JET

[75] Inventor: Myoung-Sool Lee, Kyonggi-do, Rep. of Korea

[73] Assignee: SamSung Electronics Co., Ltd., Suwon, Rep. of Korea

[21] Appl. No.: 08/951,974

[22] Filed: Oct. 16, 1997

[30] Foreign Application Priority Data

Oct. 16, 1996 [KR] Rep. of Korea ..... 96-46285

[51] Int. Cl.[6] ..... B41J 13/02

[52] U.S. Cl. ..... 400/625; 400/636; 400/641; 347/104

[58] Field of Search ..... 400/579, 625, 400/636, 637.3, 637.4, 637.5, 637.6, 641, 642; 271/314, 306, 307, 188; 346/134; 347/104, 105

[56] References Cited

U.S. PATENT DOCUMENTS

| | | | |
|---|---|---|---|
| 4,988,087 | 1/1991 | Sardano et al. | 347/16 |
| 5,370,380 | 12/1994 | Suzuki et al. | 271/314 |
| 5,420,621 | 5/1995 | Richtsmeier et al. | 347/104 |
| 5,466,079 | 11/1995 | Quintana | 271/21 |
| 5,469,197 | 11/1995 | Hiramatsu | 271/10.12 |
| 5,506,606 | 4/1996 | Saikawa et al. | 346/134 |
| 5,534,894 | 7/1996 | Hirano et al. | 346/134 |
| 5,534,902 | 7/1996 | Hoesly | 347/104 |
| 5,540,423 | 7/1996 | Nakano | 400/579 |

*Primary Examiner*—Christopher A. Bennett
*Attorney, Agent, or Firm*—Robert E. Bushnell, Esq.

[57] ABSTRACT

A paper eject apparatus for preventing a paper jam caused by a curled paper, by ejecting the curled paper outside passing between an eject roller and an idler roller. The paper eject apparatus of the ink-jet printer for preventing the paper from being jammed differentiates positions to be contacted between each idler roller and eject roller, and moves a carriage from the position of a protrusive idler roller to the position of the other idler rollers. Accordingly, the deflector placed at the lower part of the carriage presses the paper and enables the paper to easily be passed, thereby preventing the paper jam caused by the supply of the curled paper.

18 Claims, 3 Drawing Sheets

PAPER EJECT APPARATUS AND METHOD OF AN INK-JET

CLAIM OF PRIORITY

This application makes reference to, incorporates the same herein, and claims all benefits accruing under 35 U.S.C. § 119 from an application for PAPER EJECT APPARATUS OF AN INK-JET PRINTER earlier filed in the Korean Industrial Property Office on Oct. 16, 1996 and there duly assigned Ser. No. 46285/1996.

FIELD OF THE INVENTION

The present invention relates to a paper eject apparatus of an ink-jet printer, and more particularly to an improved paper eject apparatus of an ink-jet printer for preventing a paper from being jammed which can be generated when the paper escapes from a transport path in the case that the paper whose end is folded is fed.

DESCRIPTION OF THE RELATED ART

Generally, an ink-jet printer (hereinafter, referred to as a printer) performs a transportation of a carriage and line feed of a paper. A cartridge having a spray head is mounted on the carriage which performs a reciprocation movement. As the cartridge is moved, ink is ejected through a nozzle of the spray head, and thereby printing is performed.

When a row is printed as the cartridge is moved by the carriage, the paper is fed as much as the lines which is printed by a feed roller driven by a step motor. This operation is repeatedly performed to proceed the printing operation.

Upon discharge from a printing apparatus, a sheet of paper is engaged by an eject roller and a plurality of idler rollers. Often, each of the plurality of idler rollers are identical. By moving one idler roller forward, paper jams can be prevented as one corner of a sheet of paper is engaged before the other corner is engaged.

U.S. Pat. No. 5,540,423 for a Sheet Feeding Device Having A Plurality of Rollers Positioned Side by Side to Nakano discloses a sheet ejector where all the idler rollers are not identical. Each idler roller exerts a different force on the sheet of paper upon discharge. U.S. Pat. No. 4,988,087 for a Sheet Stacker to Sardano et al discloses an eject shaft that contains both fibrous brushes and foam drive rollers. The fibrous brushes have a larger diameter than the foam drive rolls.

What is needed is a sheet ejector where the shaft contains a plurality of idler rollers where one is displaced forward or protrudes forward from the other idler rollers. This would allow one corner of the sheet to become engaged before the remainder of the leading edge of the sheet becomes engaged. This will prevent curled papers from jamming upon discharge.

SUMMARY OF THE INVENTION

Therefore, it is an object to provide a paper eject apparatus for preventing a paper jam caused by a curled paper, by ejecting the curled paper outside passing between an eject roller and an idle roller.

It is another object to provide one of a plurality of idler rollers to be displaced forward from the remaining idler rollers to enable one corner of the leading edge of a sheet of discharging paper to be engaged before the remaining portion of the leading edge.

To achieve the above-mentioned object, a paper eject apparatus of an ink-jet printer according to the present invention, includes: a paper eject roller; a plurality of idler rollers being rotated in contact with the paper eject roller for ejecting a paper; at least one protrusive idler roller holder out of a plurality of idler roller holders for fixedly supporting the idler rollers; and at least one protrusive idler roller attached to the protrusive idler roller holder.

Preferably, the protrusive idler roller holder and the protrusive idler roller attached thereto are located at one end of a plurality of the idler roller holders.

Preferably, the paper eject apparatus further includes a carriage which moves to a position of the protrusive idler roller of one end when the paper is contacted with the protrusive idler roller; and moves to the other end, when the paper is supplied to the other idler rollers excluding the protrusive idler roller of one end.

Preferably, at the lower part of the carriage, a deflector is formed to guide the movement direction of the paper by keeping the paper down.

Preferably, each protrusive idler roller holder is located at both ends of a plurality of the idler roller holder, separately.

Preferably, the protrusive idler roller holder is one of the plurality of idler roller holders excluding the idler roller holders respectively located at both ends of a plurality of idler roller holders.

More preferably, the paper eject apparatus of the ink-jet printer further includes a carriage which moves to a position of the protrusive idler roller of one end when the paper is contacted with the protrusive idler roller; and moves to the position of the other idler rollers when the paper is supplied to the other idler rollers excluding the protrusive idler roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar elements components, wherein.

DETAILED DESCRIPTION OF THE INVENTION

Figure 1:
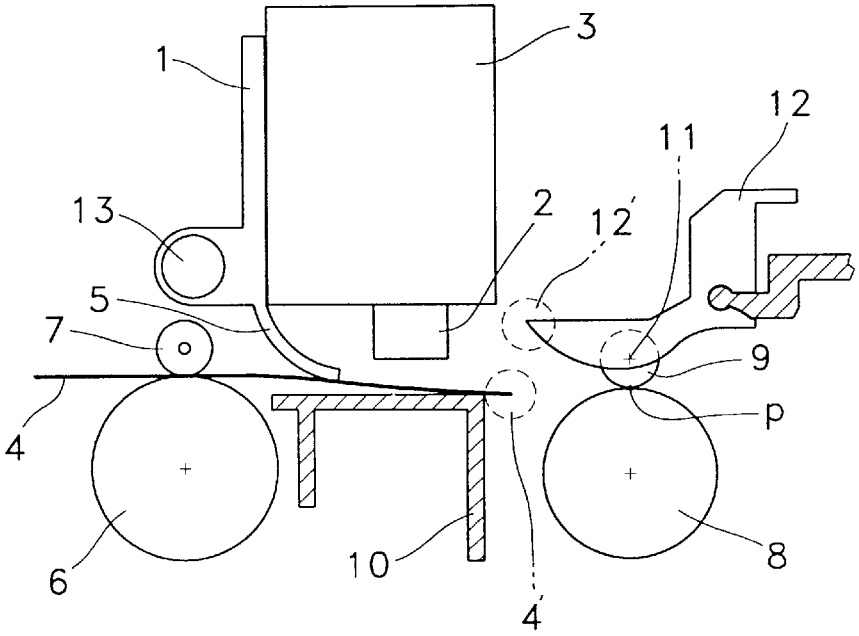
Fig. 1 Conventional Art
FIG. 1 is a left-side view illustrating an earlier structure of an ink-jet printer.

Turning to the figures, FIG. 1 is a left-side view illustrating an earlier structure of a printer. As shown in the drawing, a head 3 having a nozzle 2 is mounted on a carriage 1, and a deflector 5 is provided at the bottom side of the carriage 1 to maintain a proper interval between a paper 4 and the nozzle 2.

At the upper part of a feed roller 6 for feeding the paper 4, a pinch roller 7 is contacted. An idler roller 9 is contact with an eject roller 8 for ejecting the paper 4. Furthermore, a paper guide 10 is located between the feed roller 6 and the eject roller 8, and the paper which is fed is located between the idler roller 9 and the eject roller along the paper guide 10.

Here, a central axis 11 of the idler roller 9 is fixed at a idler roller holder 12, and it is supported by the idler roller holder 12. Moreover, a guide part 12' of the idler roller holder 12 provided at the side where the idler roller 9 is formed and guides a path so that an end 4' of the paper 4 which is fed by the feed roller 6 and transported between the paper guide 10 and the deflector 5 can easily be placed between the eject roller 8 and the idle roller 9.

The paper 4 supplied from the outside passes between the pinch roller 7 which presses the paper 4 by a spring (not illustrated in the drawing) and the feed roller 6, and then passes between the paper guide 10 and the deflector 5. After that, the paper 4 passes between the eject roller 8 and the idler roller 9. When the paper 4 is between the feed roller 6 and the eject roller 8, it is printed by the nozzle 2 of the head 3, and then ejected outside passing between the idler roller 9 and the eject roller 8.

Here, the eject roller 8 is driven by the power of a motor (not illustrated in the drawing), and the idler roller 9 whose central axis 11 is fixed at the idler roller holder 12 presses the paper 4 by the load of the idler roller holder 12, and thereby the rotary power of the eject roller 8 is carried to the paper 4.

Figure 2:
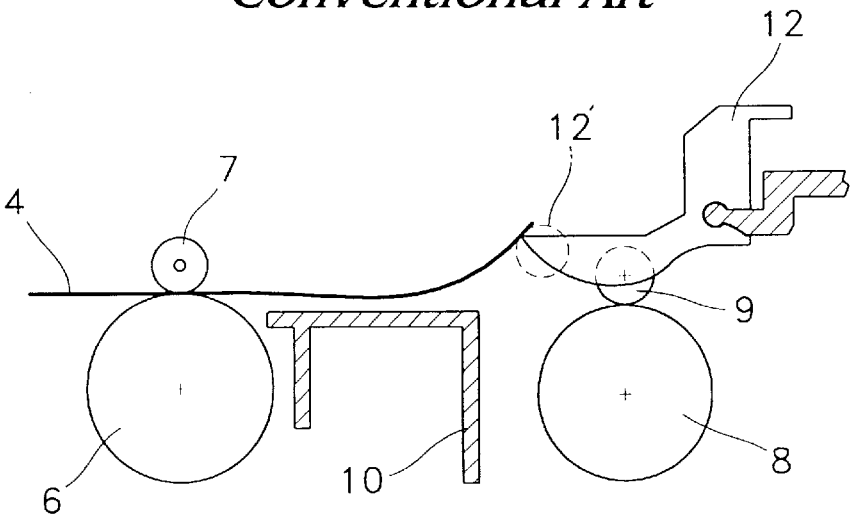
Fig. 2 Conventional Art
FIG. 2 is a view illustrating a state of paper jam caused by a curled paper of FIG. 1.

When the paper 4 is supplied, the end 4' of the paper 4 passes between the feed roller 6 and the pinch roller 7, and it is contacted with each contact point where a plurality of idler rollers 9 and the eject roller 8 are met. After that, the paper 4 passes between the idler roller 9 and the eject roller At this time, a paper having two faces one face of which is already printed or a paper which is exposed to humidity or heat can be used. In this case, the end 4' of the paper 4 is generally not even, and thereby it can be curled. Also, in the case that the paper 4 is curled when passing through the feed roller 6, as shown in FIG. 2, the paper 4 which is curled does not pass between the eject roller 8 and the idler roller 9, and it is folded and escapes from the guide part 12' of the idler roller holder 12, thereby causing a paper jam.

Figure 3:
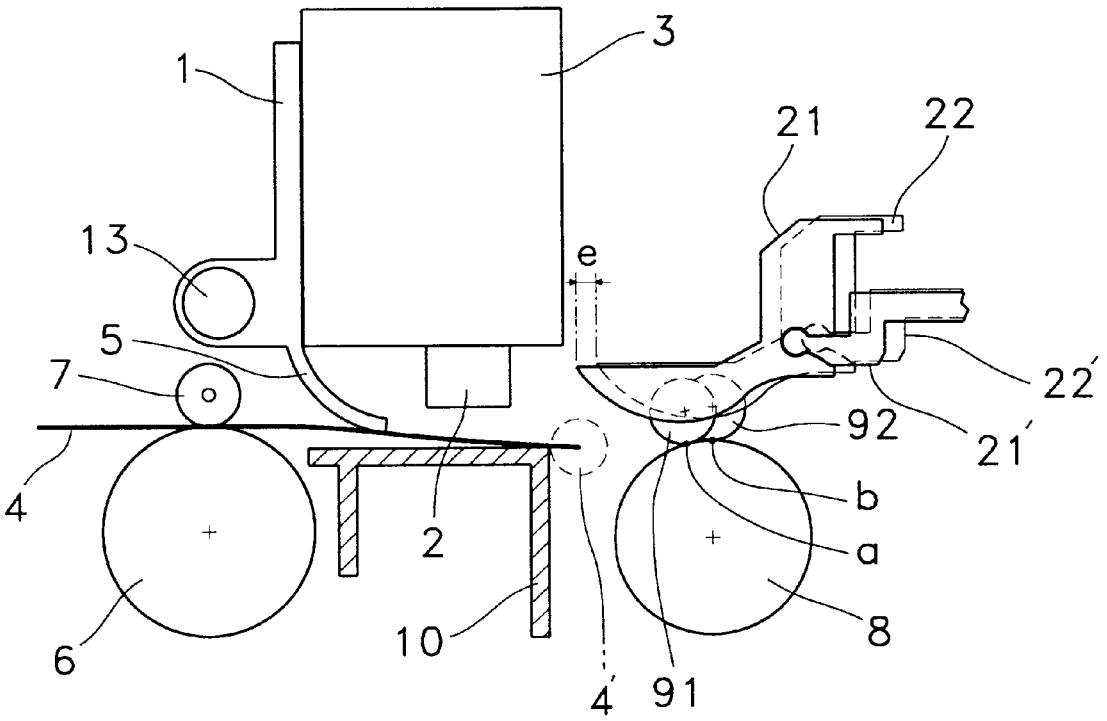
FIG. 3 is a side view illustrating one embodiment of an ink-jet printer having a structure for preventing a paper jam, according to the present invention.
Figure 4:
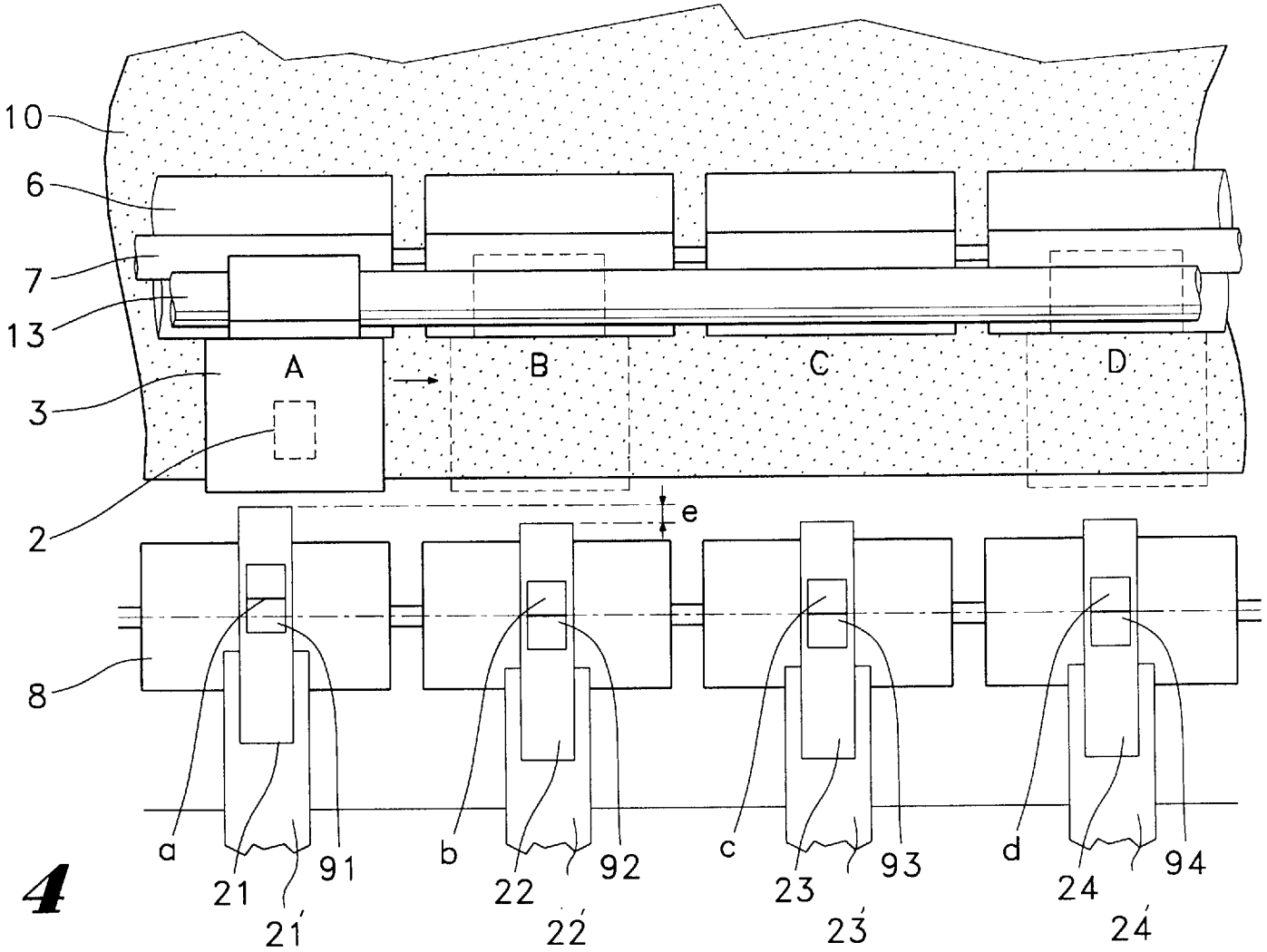
FIG. 4 is a plan view of FIG. 3.

FIGS. 3 and 4 are a side view and a plan view of one embodiment of a structure for preventing a paper jam according to the present invention, respectively. Idler rollers composed of a first idler roller 91, a second idler roller 92, a third idler roller 93 and a fourth idler roller 94 are separately located at a first idler roller holder 21, a second idler roller holder 22, a third idler roller holder 23 and a fourth idler roller holder 24, respectively. The first idler roller holder 21 out of the four idler roller holders, which is located at the end of the left side, is forwardly located as much as 'e' toward the carriage than the remaining three idler roller holders. Similarly, arms for supporting the idler roller holders are also located. In other words, an arm 21' for supporting the first idler roller holder 21 is forwardly located as much as 'e' than arms 22', 23' and 24' for the idler roller holders 22, 23 and 24. Moreover, the first idler roller 91 is forwardly located as much as 'e' than the other idler rollers 92, 93 and 94. Also, fourth idler roller holder 24, located at the end of the right side, fourth idler roller 94, and arm 24', can also be similarly forwardly located as much as 'e'. Also, alternatively, an idler roller holder located between both ends of the plurality of idler roller holders, such as second idler roller bolder 22 or third idler roller holder 23, can also be forwardly located as much as 'e', as well as its corresponding idler roller and its corresponding arm.

The operation of the present invention is explained, with reference to the drawings. When a paper 4 is supplied, an end 4' of the paper 4 passes between a feed roller 6 and a pinch roller 7, and the paper 4 is transported to an eject roller 8 via a paper guide 10. As the first idler roller holder 21 which is located at the end of left side is forwardly located as much as 'e' than the other idler roller holders 22, 23 and 24, a point 'a' where the first idler roller 91 supported by the first idler roller holder 21 is contacted with the eject roller 8 is more adjacent to the feed roller 6 than points 'b', 'c', and 'd' where the other idler rollers 92, 93 and 94 are contacted with the eject roller 8. Accordingly, the end 4' of the paper 4 transported by the feed roller 6 first arrives at 'a' where the first idler roller 91 and the eject roller 8 are contacted with each other, and it is simultaneously contacted with the other idler rollers at 'b', 'c' and 'd' after transported as much as 'e'. Also, if the fourth idler roller holder 24 is also forwardly located, the end 4' of paper 4 can also first arrive at 'd' where fourth idler roller 94 and eject roller 8 are contacted with each other. Also, alternatively, if the second idler roller holder 22 or the third idler roller holder 23 is also forwardly located, the end 4' of paper 4 can also first arrive at 'b' or 'c', respectively, where second idler roller 92 or third idler roller 93 and eject roller 8 are respectively contacted with one another.

A carriage 1 is located at a point 'A' until the supplied paper 4 passes between the feed roller 6 and the pinch roller 7 and then the end 4' of the paper 4 arrives at point 'a'. At this time, a deflector 5 located at the lower part of the carriage 1 enables the left end 4' of the paper 4 contacted with the first idler roller 91 to easily passes the point 'a' by keeping the paper 4 down toward the paper guide 10.

Moreover, the left end 4' of the paper 4 passes the point 'a', the carriage 1 moves to a point 'D'. At this time, as the deflector 5 located at the lower part of the carriage 1 presses the paper 4, the end 4' of the paper 4 can easily passes a point 'd' where the fourth idler roller 94 and the eject roller 8 is contacted with each other.

Accordingly, as one idler roller is forwardly located and the deflector is located at the lower part of the carriage, the one end of the paper can be guided and ejected. As the carriage moves and the other end is pressed again by the deflector, the paper is not jammed though one end of the paper is curled. In other words, the paper 4 passes between the feed roller 6 and the pinch roller 7, and the end of the paper 4 first arrives at the first idler roller 91. After that, the carriage 1 is transported to the position of the fourth idler roller 94. Accordingly, though the paper 4 which is already curled is supplied or the paper 4 is curled during passing through the feed roller 6, the paper 4 is not jammed when passing between the idler roller 91 and the eject roller 8.

As described above, the apparatus of the ink-jet printer for preventing the paper from being jammed differentiates positions to be contacted between each idler roller and eject roller. As the carriage moves from the position of the protrusive idler roller to the positions of the other idler rollers, the deflector placed at the lower part of the carriage presses the paper and enables the paper to easily be passed, thereby preventing the paper jam caused by the supply of the curled paper.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A paper eject apparatus of an ink-jet printer, comprising:

a paper eject roller;

a plurality of idler rollers for rotation in contact with said paper eject roller for ejecting a paper; and a plurality of idler roller holders to guide and support each of said plurality of idler rollers, at least one of said plurality of idler roller holders being a protrusive idler roller holder;

wherein at least one of said plurality of idler rollers is a protrusive idler roller attached to a corresponding said protrusive idler roller holder, and wherein said paper is first contacted with at least one said protrusive idler roller attached to a corresponding said protrusive idler roller holder.

2. The apparatus of claim 1, wherein a said protrusive idler roller holder and a said protrusive idler roller attached thereto are located at one end of said plurality of idler roller holders.

3. The apparatus of claim 2, further comprising:

a movable carriage that moves from a said protrusive idler roller to a non-protrusive idler roller.

4. The apparatus of claim 3, wherein, at a lower part of said moveable carriage, a deflector is formed to guide the movement and direction of said paper by keeping the paper from becoming jammed.

5. The apparatus of claim 1, wherein a said protsive idler roller holder is respectively located at both ends of said plurality of idler roller holders.

6. The apparatus of claim 1, wherein a said protrusive idler roller holder is located between both ends of said plurality of idler roller holders.

7. The apparatus of claim 5, further comprising:

a carriage, said carriage being located at a position of said protrusive idler roller at one end of said both ends of said plurality of idler roller holders when the paper is contacted with said protrusive idler roller at said one end of said both ends, and said carriage being moved to a position of another idler roller when the paper is supplied to non-protrusive idler rollers.

8. The apparatus of claim 6, further comprising:

a carriage, said carriage being located at a position of said protrusive idler roller located between said both ends of said plurality of idler roller holders when the paper is contacted with said protrusive idler roller located between said both ends, and said carriage being moved to a position of another idler roller when the paper is supplied to non-protrusive idler rollers.

9. A method for discharging a sheet of paper from a printing apparatus, comprising:

providing a plurality of idler rollers, at least one of said plurality of idler rollers being a protruded idler roller;

engaging a portion of a leading edge of said sheet of paper between said protruded idler roller and an eject roller;

moving a carriage from said protruded idler roller to a non-protruded idler roller; and engaging a remaining portion of said leading edge of said sheet of paper between non-protruded idler rollers and said eject roller.

10. The method of claim 9, wherein a corner of said leading edge of said sheet of paper is first engaged by said protruded idler roller and said eject roller.

11. The method of claim 9, wherein a portion between corners of said leading edge of said sheet of paper is first engaged by said protruded idler roller and said eject roller.

12. An apparatus for discharging a sheet of paper from a printing apparatus, comprising:

a paper eject roller;

a protruded idler roller for contacting with said paper eject roller; and a plurality of non-protruded idler rollers for contacting with said paper eject roller.

13. The apparatus of claim 12, further comprising a movable carriage that moves between said protruded idler roller and one of said plurality of non-protruded idler rollers, said carriage having a deflector attached thereto to prevent jamming of said sheet of paper.

14. The apparatus of claim 13, wherein said protruded idler roller is positioned to one side of said plurality of non-protruded idler rollers.

15. The apparatus of claim 13, wherein said protruded idler roller is positioned between both ends of said plurality of non-protruded idler rollers.

16. The apparatus of claim 13, wherein each idler roller is guided and supported by an idler roller holder.

17. The apparatus of claim 13, wherein an idler roller holder that guides and supports said protruded idler roller is protruded.

18. The apparatus of claim 16, wherein said idler roller holder that guides and supports said protruded idler roller is protruded.

* * * * *